US009962720B2

(12) United States Patent
St. Peter et al.

(10) Patent No.: US 9,962,720 B2
(45) Date of Patent: May 8, 2018

(54) ELECTROSTATIC SPRAY NOZZLE ASSEMBLY

(71) Applicant: Spraying Systems Co., Wheaton, IL (US)

(72) Inventors: Glenn R. St. Peter, Atkinson, NH (US); John Leone, Rindge, NH (US); Charles J. Zaverson, Hudson, NH (US); Thomas E. Ackerman, Manchester, NH (US)

(73) Assignee: Spraying Systems Co., Wheaton, IL (US)

( * ) Notice: Subject to any disclaimer, the term of this patent is extended or adjusted under 35 U.S.C. 154(b) by 81 days.

(21) Appl. No.: 15/023,241

(22) PCT Filed: Sep. 22, 2014

(86) PCT No.: PCT/US2014/056728
§ 371 (c)(1),
(2) Date: Mar. 18, 2016

(87) PCT Pub. No.: WO2015/042504
PCT Pub. Date: Mar. 26, 2015

(65) Prior Publication Data

US 2016/0228892 A1 Aug. 11, 2016

Related U.S. Application Data

(60) Provisional application No. 61/880,238, filed on Sep. 20, 2013.

(51) Int. Cl.
*B05B 5/03* (2006.01)
*B05B 5/043* (2006.01)
(Continued)

(52) U.S. Cl.
CPC ..... *B05B 5/03* (2013.01); *B05B 5/043* (2013.01); *B05B 5/0533* (2013.01); *B05B 5/1608* (2013.01); *B05B 7/067* (2013.01)

(58) Field of Classification Search
CPC ..... B05B 5/025; B05B 5/0255; B05B 5/03; B05B 5/043; B05B 5/0533; B05B 5/1608; B05B 7/066; B05B 7/067
(Continued)

(56) References Cited

U.S. PATENT DOCUMENTS 3,408,985 A 11/1968 Sedlacsik
3,672,569 A * 6/1972 Smead ..... B05B 5/03 239/704
(Continued)

OTHER PUBLICATIONS

European Search Report dated Mar. 12, 2017, in European Patent Application No. 14845379.8.

*Primary Examiner* — Alexander Valvis
(74) *Attorney, Agent, or Firm* — Leydig, Voit & Mayer, Ltd.

(57) ABSTRACT

An air assisted electrostatic liquid spray nozzle assembly having a relatively long elongated nozzle body with a spray tip and surrounding air cap disposed at a downstream end of the nozzle body. The spray nozzle assembly includes an upstream electrode for connection to a high voltage electric source, an elongated feed tube, an electrically enhancing stinger, and the spray tip which are secured and retained by the air cap in electrically conductive relation to each other such that liquid passing through liquid passages of the electrode, feed tube, stinger, and spray tip is discharged in an electrostatically charged pattern of liquid particles. The air cap is removable to permit easy removal and replacement of the spray tip, stinger, and liquid feed tube.

19 Claims, 5 Drawing Sheets

(51) Int. Cl.
*B05B 5/16* (2006.01)
*B05B 7/06* (2006.01)
*B05B 5/053* (2006.01)

(58) Field of Classification Search
USPC ..... 239/690, 704, 706; 118/626
See application file for complete search history.

(56) References Cited

U.S. PATENT DOCUMENTS

| | | | | |
|---|---|---|---|---|
| 3,746,253 | A | 7/1973 | Walberg | |
| 4,545,536 | A | 10/1985 | Avidon | |
| 4,824,026 | A * | 4/1989 | Tamura | B05B 5/03 239/412 |
| 5,409,162 | A * | 4/1995 | Sickles | B05B 5/043 239/296 |
| 5,765,761 | A * | 6/1998 | Law | B05B 5/03 239/690.1 |
| 7,748,651 | B2 * | 7/2010 | Amari | B05B 5/03 239/290 |
| 7,762,481 | B2 * | 7/2010 | Clifford | B05B 5/1633 239/105 |
| 7,784,718 | B2 * | 8/2010 | Ohno | B05B 5/03 239/291 |
| 8,434,702 | B2 * | 5/2013 | Mori | B05B 5/053 239/302 |
| 8,443,754 | B2 * | 5/2013 | Yamada | B05B 5/0535 118/323 |
| 2005/0175772 | A1 | 8/2005 | Worsham et al. | |
| 2007/0199824 | A1 * | 8/2007 | Hoerr | B05B 5/025 205/80 |
| 2012/0240851 | A1 * | 9/2012 | Murata | B05B 5/0535 118/663 |

* cited by examiner

ELECTROSTATIC SPRAY NOZZLE ASSEMBLY

CROSS-REFERENCE TO RELATED APPLICATIONS

This patent application claims the benefit of U.S. Patent Application No. 61/880,238, filed Sep. 20, 2013, which is incorporated by reference.

FIELD OF THE INVENTION

The present invention relates generally to spray nozzle assemblies, and more particularly, to electrostatic spray nozzle assemblies that electrostatically charge fluids discharging from spray nozzles to facilitate liquid particle breakdown and distribution.

BACKGROUND OF THE INVENTION

Electrostatic spray nozzle assemblies are utilized for spraying coatings, lubricating fluids and other liquids in various manufacturing processes. To effect adequate liquid particle breakdown for the desired spray application, it often is necessary to further utilize pressurized air.

In some installations, it is necessary that the spray nozzle assemblies have a relatively long nozzle body with the spray nozzle at the discharge end located a relatively long distance from the liquid inlet, pressurized atomizing air inlet, and high voltage cable connection for the spray nozzle assembly. It can be difficult to properly assemble, install or repair the spray nozzle assemblies in such installations, and improper or imprecise assembly of such spray nozzles and charging electrodes can result in high voltage leakage that can significantly effect the operating efficiency of the spray operation.

OBJECTS AND SUMMARY OF THE INVENTION

It is an object of the invention to provide a pressurized air assisted electrostatic spray nozzle assembly that is adapted for more efficient and reliable operation.

Another object is to provide a spray nozzle assembly as characterized above which has a relatively long barrel extension or nozzle body and which lends itself to easier assembly, installation and repair.

A further object is to provide an electrostatic spray nozzle assembly of the above kind that is relatively simple in construction and lends itself to economical manufacture.

Other objects and advantages of the invention will become apparent upon reading the following detailed description and upon reference to the drawings, in which:

Figure 1:
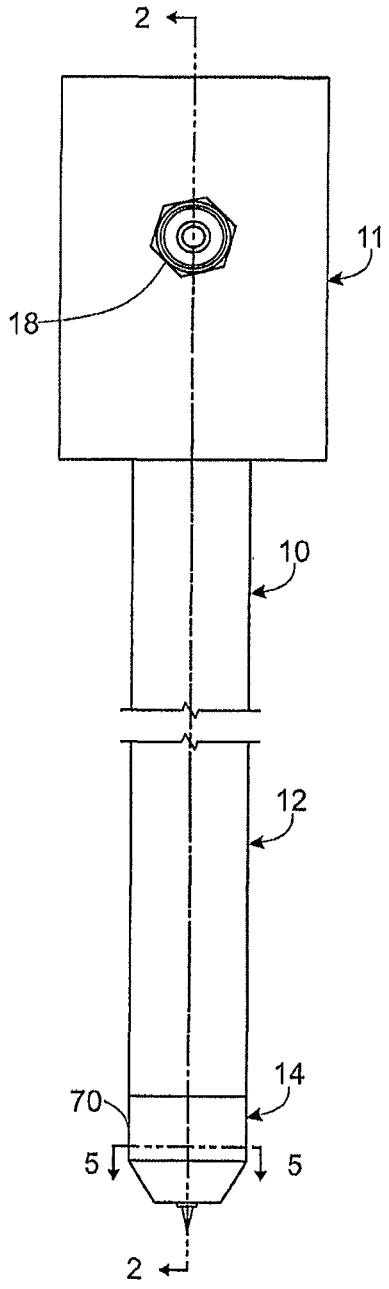
FIG. 1 is a side elevational view of an illustrative spray nozzle assembly in accordance with the invention.
Figure 2:
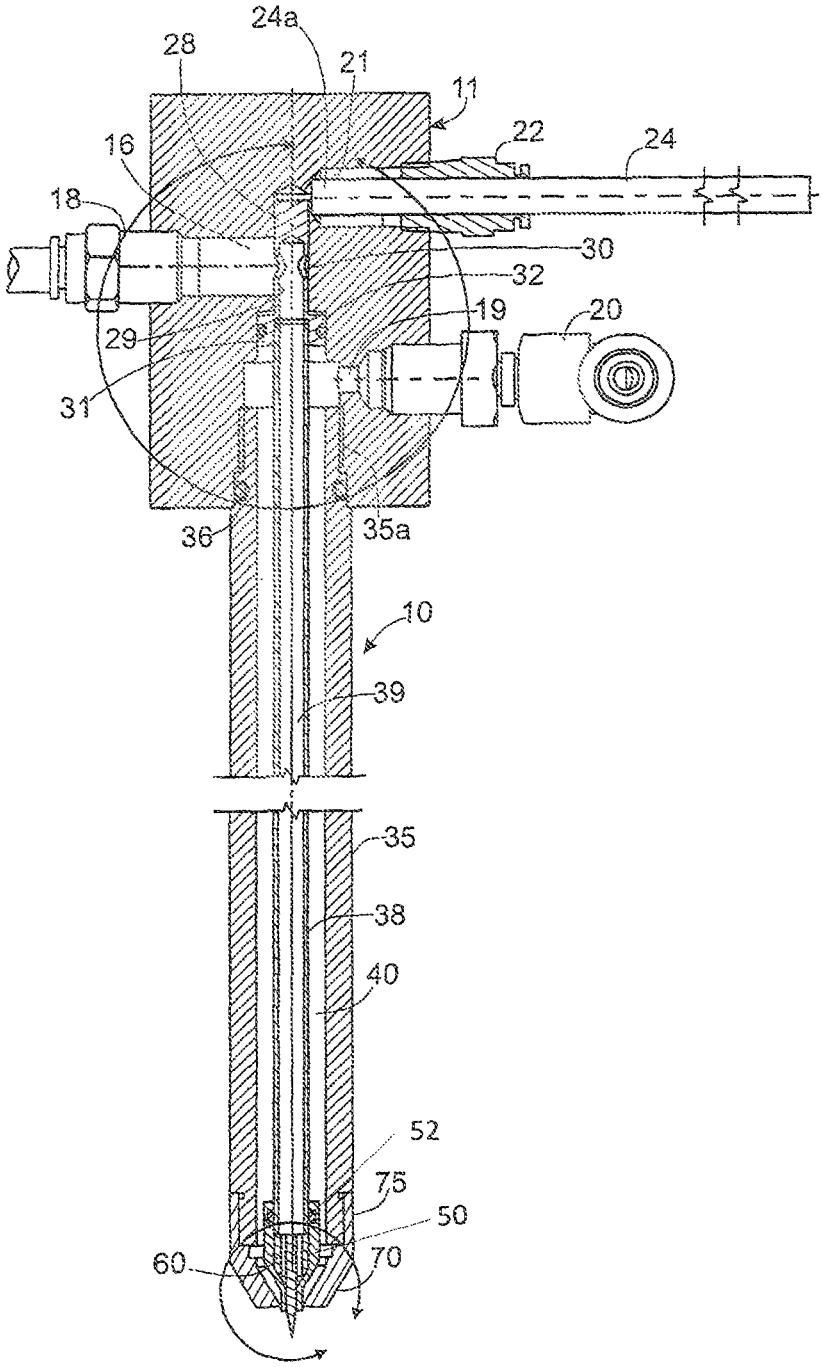
FIG. 2 is a vertical section of the illustrated spray nozzle assembly taken in the plane of line 2-2 in FIG. 1.
Figure 3:
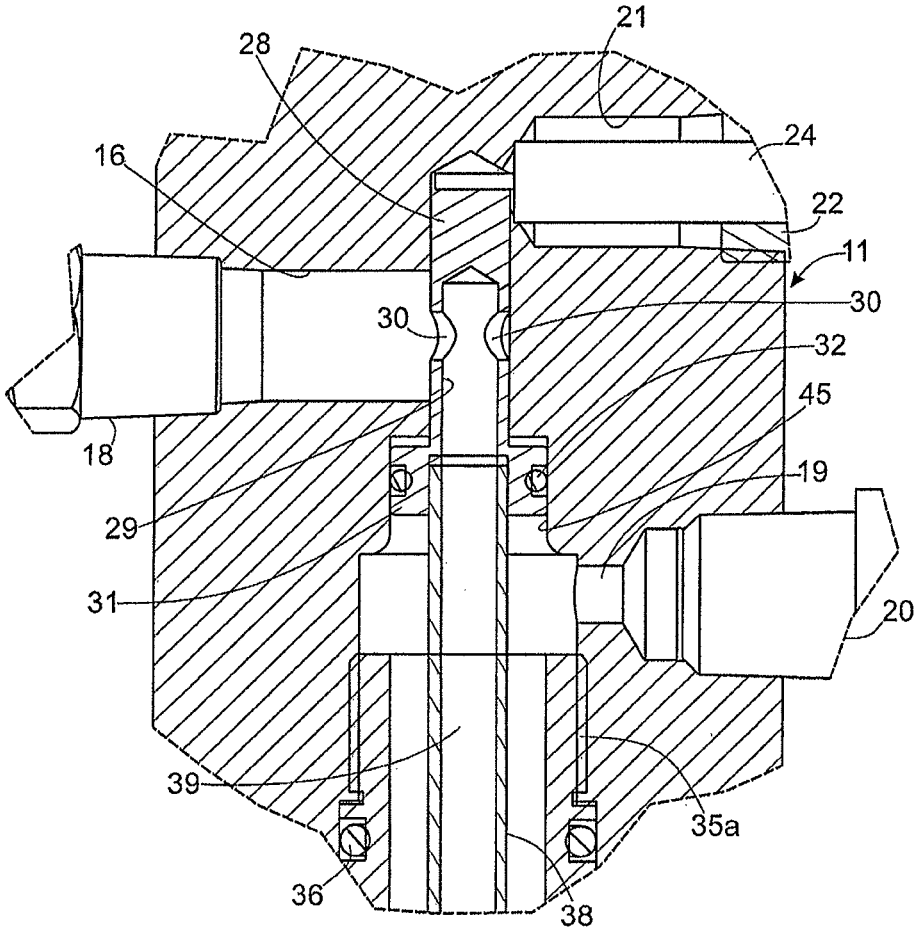
FIG. 3 is an enlarged fragmentary section of the input head of the illustrated spray nozzle assembly.
Figure 4:
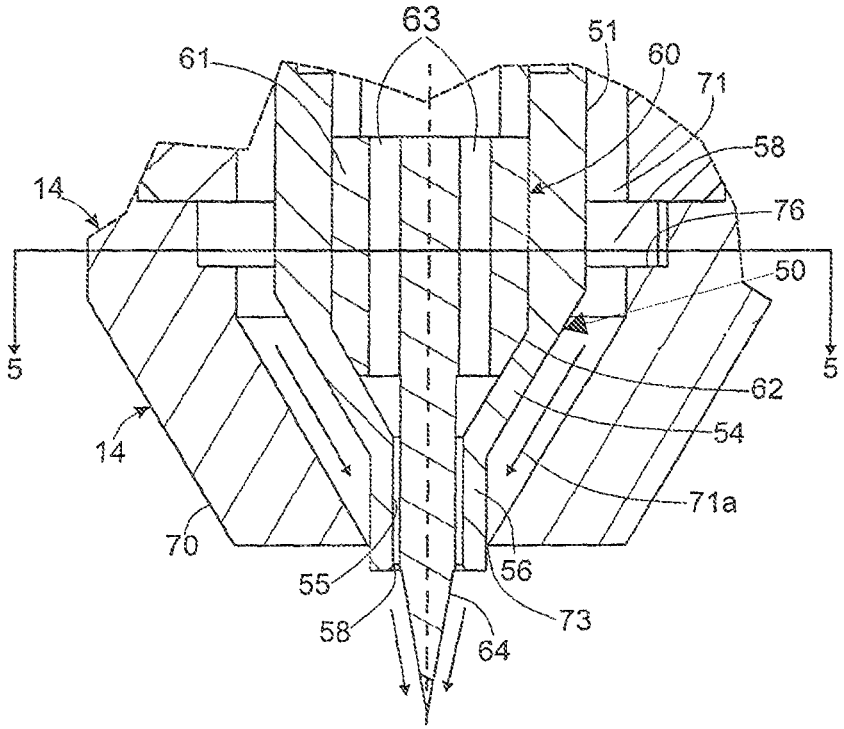
FIG. 4 is an enlarged fragmentary section of the discharge end of the illustrated spray nozzle assembly.
Figure 5:
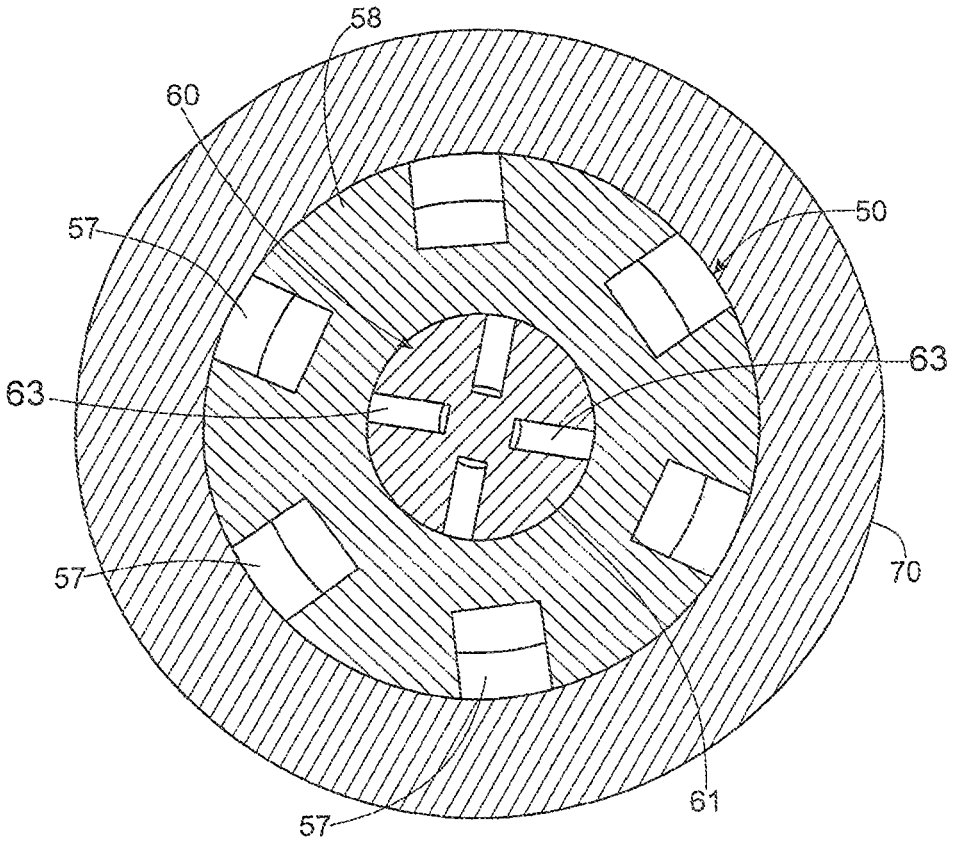
FIG. 5 is a transverse fragmentary section of the spray nozzle assembly taken in the line of 5-5 in FIG. 4.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DESCRIPTION OF THE PREFERRED EMBODIMENT

Referring now more particularly to the drawings, there is shown an illustrative pressurized air atomizing electrostatic spray nozzle assembly 10 in accordance with the invention. The illustrated spray nozzle assembly 10 includes a fluid and high voltage input head 11, an elongated nozzle barrel or body 12 extending downstream from the input head 11, and a discharge nozzle assembly 14 at a downstream end of the elongated nozzle body 12. It will be understood that the nozzle body 12 may be relatively long in length in relation to its diameter for enabling mounting of the spray nozzle assembly 10 in a wall of a processing vessel or the like with the discharge nozzle assembly 14 within the vessel and the input head 11 remotely located outside the vessel. In practice, the elongated nozzle body 12 may have a length of 10 times or more the diameter of the nozzle body 12, up to 12 inches or more.

The input head 11 in this case is cylindrical in form, made of plastic or other nonelectrically conducive material, formed with a radial liquid inlet passage 16 that receives and communicates with a liquid inlet fitting 18 connected to a pressurized liquid supply. The input head 11 is formed with a radial pressurized air atomizing inlet passage 19 downstream of said liquid inlet passage 16 that receives and communicates with an air inlet fitting 20 coupled to a suitable pressurized air supply. The input head 11 further has a radial passage 21 upstream of the liquid inlet passage 16 that receives a fitting 22 for securing a high voltage cable 24 connected to a high voltage source and having an end 24*a* extending into the passage 21 in abutting electrically contacting relation to an electrode 28 axially supported within the input hub 11 and extending downstream of the liquid inlet passage 16.

For enabling liquid passage through the input head 11, the electrode 28 is formed with an internal axial passage 29 communicating with the liquid inlet passage 16 and extending downstream though the electrode 28. The electrode 28 in this case is formed with a plurality of radial passages 30 communicating between the liquid inlet passage 16 and the internal axial passage 29. The illustrated electrode 28 has a downstream outwardly extending radial hub 31 fit within a counter bore of the inlet head 11 with a sealing o-ring 32 interposed there between.

In carrying out this embodiment, the elongated body 12 includes an outer cylindrical body member 35 made of plastic, such as sold under the trade name UItem, or other suitable nonconductive material, having an upstream end 35*a* threadedly engaged within a threaded bore of the input hub 11 with a sealing o-ring 36 interposed between the cylindrical body member 35 and the input hub 11. A liquid feed tube 38, made of stainless steel or other electrically conductive metal, extends axially through the outer cylindrical body member 35 for defining a liquid flow passage 39 for communicating liquid between the axial electrode liquid passage 29 and the discharge nozzle assembly 14 and for defining an annular atomizing air passage 40 between the liquid feed tube 38 and the outer cylindrical body member 35. An upstream end of the liquid feed tube 38 which protrudes above the threaded inlet end 35*a* of the outer cylindrical nozzle body 35 fits within a downwardly opening cylindrical bore 45 in the electrode hub 31 in electrical conducting relation. With the electrode 28 charged by the high voltage cable 24, it will be seen that liquid feed to the inlet passage 16 will be electrically charged during its travel through the electrode passage 29 and liquid feed tube 38 along the entire length of the elongated nozzle body 12. Pressurized air in this case communicates through the radial pressurized air inlet passage 19 about the upstream end of the liquid feed tube 38 and then into the annular air passage 40 between the liquid feed tube 38 and the outer cylindrical body member 35.

In keeping with this embodiment, the liquid feed tube 38 is maintained in precise reliable electrical contacting relation with the electrode 28 for efficiently electrically charging liquid throughout its passage from the input hub 11 and through elongated nozzle body member 12 to the spray tip 50. To this end, the discharge nozzle assembly 14 includes a spray tip 50 having an upstream cylindrical section 51 in surrounding relation to a downstream end of the liquid feed tube 38 with a sealing o-ring 52 interposed therebetween. The spray tip 50 includes an inwardly tapered or conical intermediate section 54 and a downstream cylindrical nose section 56 that defines a cylindrical flow passage 55 and a liquid discharge orifice 58 of the spray tip 50. The spray tip 50 in this case has a segmented radial retention flange 58 extending outwardly of the upstream cylindrical section 51 which defines a plurality of air passages 57, as will become apparent.

For channeling liquid from feed tube 38 into and though the spray tip 50 while continuing to electrostatically charge the liquid as it is directed through the spray tip 50, an electrically conductive stinger unit 60 is supported within the spray tip 50 in abutting electrically conductive relation to the downstream end of the feed tube 38. The stinger unit 60 in this case comprises an upstream cylindrical hub section 61 formed with a downstream conical wall section 62 supported within the intermediate conical section 54 of the spray tip 50. The cylindrical hub section 61 is formed with a plurality of circumferentially spaced radial liquid flow passageways 63 communicating between the liquid feed tube 38 and the spray tip flow passage section 55. It will be seen that the electrically conductive stinger unit 60, when seated within the spray tip 50, physically supports in abutting relation the downstream end of the liquid feed tube 38.

For concentrating the electrical charge on liquid discharging from the spray tip, the stinger unit 60 has a downwardly extending central electrode pin 64 supported in concentric relation to the spray tip passage 55 such that the liquid discharge orifice 58 is annularly disposed about the electrode pin 64. The electrode pin 64 has a gradually tapered pointed end 64 which extends a distance, such as between about ¼ and ½ inch, beyond the annular spray tip discharge orifice 58. It will be understood by a person skilled in the art that the increased contact of the liquid about the protruding electrode pin 64 as it exits the spray tip 50 further enhances concentration of the charge on the discharging liquid for enhanced liquid particle breakdown and distribution.

In further keeping with this embodiment, the discharge nozzle assembly 14 includes an air cap 70 disposed about the spray tip 50 which defines an annular atomizing air passage 71 about the spray tip 50 and which retains the spray tip 50, stinger unit 60, and liquid feed tube 38 in assembled conductive relation to each other. The air cap 70 in this instance defines a conical pressurized air flow passage section 71*a* about the downstream end of the spray tip 50 which communicates via the circumferentially spaced air passages 57 in the spray tip retention flange 58 with the annular air passage 40 between the liquid feed tube 38 and the outer cylindrical body member 35 for directing a pressurized air discharge stream through an annular discharge orifice 73 about the spray tip nose 56 and liquid discharging from the spray tip liquid discharge orifice 58. For retaining the internal components of the spray nozzle in assembled relation, the air cap 70 has an upstream cylindrical end 75 in threaded engagement about a downstream outer threaded end of the outer cylindrical member 35. The air cap 70 has a counter bore 76 which receives and supports the segmented radial flange 58 of the spray tip 50 for supporting the spray tip 50, and hence, the stinger unit 60 and liquid feed tube 38 in electrical conducting relation with the upstream electrode 28.

It will be understood that with such air cap securement arrangement at the discharge end of the spray nozzle assembly upon disengagement and removal of the air cap 70 from the outer cylindrical body member 35, the spray tip 50, stinger unit 60, and liquid feed tube 38 can easily be assembled and removed without disassembly of the outer annular body member 35 from the input hub 11. Hence, the air cap 70 not only defines an atomizing air passageway, but supports the liquid feed tube 38 and stinger unit 60 in electrical contacting relation with the electrode 28 in the input unit 11 such that upon unscrewing of the air cap 70 from the outer cylindrical nozzle body 35, easy access is permitted to internal components of the spray nozzle assembly 10 for repair and/or replacement.

The invention claimed is:

1. An electrostatic spray nozzle assembly comprising:

an input head made of a non-electrically conductive material, an elongated hollow nozzle body having an upstream end supported by said input head made of a non-electrically conductive material, said input head having a liquid inlet for coupling to a liquid supply, an electrode supported within said input head for connection to a high voltage electrical source, said electrode having a liquid passage communicating with said liquid inlet, an elongated feed tube disposed within said elongated nozzle body having an upstream end in electrically conductive contacting relation to said electrode and having a liquid passage communicating with said electrode liquid passage, said feed tube and elongated nozzle body defining an air flow passage having a pressurized air inlet for coupling to a pressurized air source, a spray tip at a downstream end of said nozzle body in electrically conductive contacting relation to a downstream end of said elongated feed tube and having a liquid passage in communication with said feed tube liquid passage and a discharge orifice for discharging liquid from the spray nozzle assembly, said spray tip, liquid feed tube, and electrode being positioned in electrically conductive relation to each other such that upon coupling of said electrode to the high voltage electrical source, liquid passing through said liquid passages of said electrode, feed tube, and spray tip is electrically charged for discharge from said spray tip in a pattern of electrostatically charged liquid particles, an air cap secured to a downstream end of said elongated nozzle body, and said air cap defining an air flow passage about said spray tip in communication with said air passage defined by said feed tube and nozzle body and having an air discharge orifice from which pressurized air is directed about said pattern of electrostatically charged liquid particles discharging from said spray tip.

2. The electrostatic spay nozzle assembly of claim 1 in which said air cap is removably secured to said nozzle body such that upon removal of said air cap, said spray tip and feed tube are removable from the nozzle body from said downstream end thereof.

3. The electrostatic spay nozzle assembly of claim 1 in which said nozzle body has an elongated length of at least ten times its diameter.

4. The electrostatic spay nozzle assembly of claim 1 in which said nozzle body has an elongated length of at least twelve inches.

5. The electrostatic spay nozzle assembly of claim 1 in which said pressurized air inlet communicates through said input head with said air flow passage defined by said feed tube and said nozzle body.

6. The electrostatic spay nozzle assembly of claim 1 in which said electrode is supported within said input head with the liquid passage thereof in axial alignment with the feed tube liquid passage, said liquid inlet communicating with said electrode liquid passage through a side thereof.

7. The electrostatic spay nozzle assembly of claim 1 in which said feed tube extends beyond an upstream end of said nozzle body into a receptacle of said electrode in electrically conducting relation therewith.

8. The electrostatic spay nozzle assembly of claim 1 in which said liquid feed tube and elongated nozzle body define an annular air passage about the feed.

9. An electrostatic spray nozzle assembly comprising:

an input head made of non-electrically conductive material an elongated hollow nozzle body supported by said input head made of a non-electrically conductive material, said input head having a liquid inlet for coupling to a liquid supply, an electrode supported within said input head for connection to a high voltage electrical source, said electrode having a liquid passage communicating with said liquid inlet, an elongated feed tube disposed within said elongated nozzle body having a liquid passage communicating with said electrode liquid passage, said feed tube and elongated nozzle body defining an air flow passage having a pressurized air inlet for coupling to a pressurized air source, a spray tip at a downstream end of said nozzle body having a liquid passage in communication with said feed tube liquid passage and a discharge orifice for discharging liquid from the spray nozzle assembly, said spray tip, liquid feed tube, and electrode being positioned in electrically conductive relation to each other such that upon coupling of said electrode to an high voltage electrical supply source, liquid passing through said liquid passage of said electrode, feed tube, and spray tip is electrically charged for discharge from said spray tip in a pattern of electrostatically charged liquid particles a stinger disposed within said spray tip in interposed electrically conductive relation between said spray tip and feed tube, said stinger having a liquid passage communicating between said feed tube and spray tip liquid passages, and said stinger having a downstream electrode pin positioned concentrically within said spray tip passage and protruding outwardly of said spray tip discharge orifice for enhancing electrostatic charging of liquid discharging from the spray tip, and an air cap secured to said downstream end of said elongated nozzle body for securing and retaining said spray tip, liquid feed tube, and electrode in electrically conductive relation to each other, and said air cap defining an air flow passage about said spray tip in communication with said air passage defined by said feed tube and nozzle body and having an air discharge orifice from which pressurized air is directed about said pattern of electrostatically charged liquid particles discharging from said spray tip.

10. The electrostatic spay nozzle assembly of claim 9 in which said spray tip has an upstream cylindrical section, an inwardly tapered intermediate conical section, and a downstream cylindrical nose portion which defines said spray tip discharge orifice, and said stinger has an upstream cylindrical portion concentrically disposed within the cylindrical upstream section of said spray tip, a conical intermediate section seated in electrically conductive relation to the conical spray tip section, and a downstream electrode pin concentrically disposed within said spray tip nose portion and extending downstream thereof.

11. The electrostatic spay nozzle assembly of claim 10 which said stinger is formed with a plurality of liquid flow passages communicating between said feed tube and spray tip liquid passages.

12. The electrostatic spay nozzle assembly of claim 11 in which said spray tip has an outwardly extending retention flange interposed between said downstream end of said nozzle body and said air cap, and said retention flange being formed with a plurality of air passages for communicating pressurized air between said airflow passage defined between said feed tube and nozzle body and the air cap defined air flow passage.

13. An electrostatic spray nozzle assembly comprising:

an input head made of non-electrically conductive material, an elongated hollow nozzle body supported by said input head made of a non-electrically conductive material, said input head having a liquid inlet for coupling to a liquid supply, an electrode supported within said head for connection to a high voltage electrical source, said electrode having a liquid passage communicating with said liquid inlet, an elongated feed disposed within said elongated nozzle body having an elongated liquid passage communicating with said electrode liquid passage, said feed tube and elongated nozzle body defining an elongated air flow passage having a pressurized air inlet for coupling to a pressurized air source, a spray tip at a downstream end of said nozzle body having a liquid passage in communication with said feed tube liquid passage and a discharge orifice for discharging liquid from the spray nozzle assembly, a stinger disposed within said spray tip in interposed electrically conductive relation between said spray tip and feed tube, said stinger having a liquid passage communicating between said feed tube and spray tip liquid passages, and said stinger having a downstream electrode pin positioned concentrically within said spray tip passage, an air cap secured to a downstream end of said elongated nozzle body with said spray tip, stinger, liquid feed tube, and electrode being retained in electrically conducting relation to each other such that upon coupling of said electrode to the high voltage electrical source, liquid passing through said liquid passages of said electrode, feed tube, stinger, and spray tip is electrically charged for discharge from said spray tip in a pattern of electrostatically charged liquid particles, said air cap defining an air flow passage about said spray tip in communication with said elongated air passage defined by said feed tube and nozzle body and having an air discharge orifice from which pressurized air is directed about said pattern of electrostatically charged liquid particles discharging from said spray tip, and said air cap being removably secured to said nozzle body such that upon removal of said air cap, said spray tip, stinger, and feed tube are removable from the nozzle body from said downstream end thereof.

14. The electrostatic spay nozzle assembly of claim 13 in which said nozzle body has an elongated length of at least ten times its diameter.

15. The electrostatic spay nozzle assembly of claim 13 in which said spray tip has an upstream cylindrical section, an inwardly tapered intermediate conical section, and a downstream cylindrical nose portion which defines said spray tip discharge orifice, and said stinger has an upstream cylindrical portion concentrically disposed within the cylindrical upstream section of said spray tip, a conical intermediate section seated in electrically conductive relation to the conical spray tip section, and a downstream electrode pin concentrically disposed within said spray tip nose portion and extending downstream thereof.

16. The electrostatic spay nozzle assembly of claim 15 in which said air cap defines a conical air flow passage about said intermediate conical section of said spray tip.

17. The electrostatic spay nozzle assembly of claim 15 in which said stinger is formed with a plurality of liquid flow passages communicating between said feed tube and spray tip liquid passages.

18. The electrostatic spay nozzle assembly of claim 13 in which said spray tip has an outwardly extending retention flange interposed between said downstream end of said nozzle body and said air cap, and said retention flange being formed with a plurality of air passages for communicating pressurized air between said airflow passage defined between said feed tube and nozzle body and the air cap defined air flow passage.

19. The electrostatic spay nozzle assembly of claim 13 in which said pressurized air inlet communicates through said input head with said air flow passage defined by said feed tube and said nozzle body, said electrode being supported within said input head with the liquid passage thereof in axial alignment with the feed tube liquid passage, said liquid inlet communicating with said electrode liquid passageway though a side thereof.

* * * * *